United States Patent [19]

Yamada et al.

[11] Patent Number: 4,909,039

[45] Date of Patent: Mar. 20, 1990

[54] ICE MAKER OF REFRIGERATORS AND METHOD OF DETECTING WATER UNSUPPLIED CONDITION OF AN ICE TRAY OF THE ICE MAKER

[75] Inventors: Koji Yamada; Tetsuo Kimoto, both of Ibaraki; Masao Aono, Mishima, all of Japan

[73] Assignee: Kabushiki Kaisha Toshiba, Kawasaki, Japan

[21] Appl. No.: 322,268

[22] Filed: Mar. 10, 1989

[30] Foreign Application Priority Data

Mar. 12, 1988 [JP] Japan ..... 63-59180

[51] Int. Cl.[4] ..... F25B 49/00

[52] U.S. Cl. ..... 62/66; 62/125; 62/129; 340/622

[58] Field of Search ..... 62/125, 12 C, 129, 130, 62/66, 347; 340/622; 73/295; 137/554, 558

[56] References Cited

U.S. PATENT DOCUMENTS

| | | | |
|---|---|---|---|
| 3,772,673 | 11/1973 | Szeverenyi | 340/622 X |
| 4,037,427 | 7/1977 | Kramer | 340/622 X |
| 4,426,851 | 1/1984 | Neumann | 62/126 |
| 4,573,325 | 3/1986 | Chiu et al. | 62/129 |

FOREIGN PATENT DOCUMENTS

| | | |
|---|---|---|
| 51-11338 | 4/1976 | Japan . |
| 52-2928 | 1/1977 | Japan . |

*Primary Examiner*—William E. Tapolcai

*Attorney, Agent, or Firm*—Cushman, Darby & Cushman

[57] ABSTRACT

A method of detecting water unsupplied condition of an ice tray of a refrigerator ice maker includes steps of measuring the temperature of the ice tray after the water supply operation of water supply means to the ice tray is executed and determining that the water has not been supplied to the ice tray, where the measured temperature is below a predetermined reference value. An ice maker of a refrigerator includes an ice tray which is supplied with water, which is refrigerated by an evaporator so that ice is made, ice removing means for removing ice from the ice tray, water supply means for supplying water to the ice tray every time the ice is removed from the ice tray, a temperature sensor for sensing the temperature of the ice tray, and determination circuit means for comparing the temperature of the ice tray sensed by the temperature sensor with the predetermined reference value and determining that the water has not been supplied to the ice tray, where the temperature of the ice tray sensed by the temperature sensor is below the predetermined reference value.

7 Claims, 3 Drawing Sheets

ICE MAKER OF REFRIGERATORS AND METHOD OF DETECTING WATER UNSUPPLIED CONDITION OF AN ICE TRAY OF THE ICE MAKER

BACKGROUND OF THE INVENTION

1. Field of the Invention

The present invention relates to an ice maker of refrigerators wherein water contained in an ice tray is refrigerated so that ice is made and a method of detecting water unsupplied condition of the ice tray when the water has not been supplied to the ice tray in spite of execution of the water supply operation.

2. Description of the Prior Art

An automatic ice maker incorporated in refrigerators conventionally comprises an ice tray disposed in a freezing compartment or exclusive ice making compartment, a reservoir tank disposed in a storage compartment and a water supply pump for supplying water in a reservoir tank to the ice tray.

In the above-described ice maker, water is first supplied to the ice tray by the water supply pump and the water in the ice tray is refrggerated so that ice is obtained. When the ice is made, the ice tray is reversed so that the ice is remove from the ice tray. The ice is received by an ice dispenser dispose beneath the ice tray. Thereafter, when the ice tray is again reversed to the former position, water is re-supplied to the ice tray by the water supply pump. The above-described operation is reiteratively executed and more and more lumps of ice are reserved in the ice dispenser.

Japanese Published Patent Application (Kokoku) No. 5111338 and Japanese Published Utility Model Application (Kokōku) No. 52-2928 disclose means for detecting the change of water in the ice tray into ice so that the ice tray is reversed. These publications disclose a method of detecting completion of an ice making operation cycle by sensing the temperature of the ice tray which is decreased below 0° C. when the water in the ice tray is changed to ice. More specifically, a temperature sensor such as a thermistor is mounted on the ice tray and it is determined that the ice making operation cycle is completed when the temperature of the ice tray detected by the sensor takes a predetermined small value. Then, switch means comprising electronic circuitry is activated in response to temperature detection signal so that an electric drive motor is energized to reverse the ice tray. After tee ice tray is reversed and lumps of ice are removed therefrom, the ice tray is again reversed to the former position and the water is again supplied thereto. The water supply to the ice tray causes the temperature of the ice tray to be increased. The temperature increase of the ice tray is sensed by the temperature sensor and the motor is deenergized by the switch means when the temperature sensed by the temperature sensor takes a predetermined large value.

According to the conventional ice maker of the refrigerator, the ice making operation cycle from the water supply to the ice tray to the removal of ice therefrom can be reiterated by detecting the changing of water in the ice tray into ice. The water in the reservoir tank is decreased with reiterative execution of the ice making operation cycle. Conventionally, a user observes the residual quantity of water in the reservoir tank and water is added or supplied in case of need.

However, when the user forgets to supply water to the reservoir tank, the tank will be emptied. Consequently, water is not supplied to the ice tray even though the water supply pump is driven to supply water to the ice tray and accordingly, ice will not be made.

In the above-described condition, the user finds out that smaller number of lumps of ice has been reserved in the ice dispenser and that the reservoir tank has been emptied only when he or she takes out the lumps of ice from the ice dispenser. Consequently, a problem arises that a necessary amount of ice cannot be obtained when the user needs the ice.

In order to solve the above-described problem, the condition that water has not been supplied to the ice tray needs to be detected. However, such a detecting method or device has not been devised nor actualized as far as the inventors know.

SUMMARY OF THE INVENTION

Therefore, a primary object of the present invention is to provide a method of detecting water unsupplied condition of the ice tray of the ice maker of the refrigerator, wherein the condition that water has not been supplied to the ice tray can be detected when the water is not supplied to the ice tray even though the water supply operation is executed by the water supply means.

A second object of the invention is to provide an ice maker of a refrigerator wherein the condition that water has not been supplied to the ice tray can be detected when the water is not supplied to the ice tray even though the water supply operation is executed by the water supply means.

According to the present invention, the method of detecting water unsupplied condition of an ice tray of a refrigerator ice maker, wherein ice maker water supplied to the ice tray by water supply means is refrigerated by refrigerating means to thereby obtain ice, which is removed from the ice tray by ice removing means and wherein water is reiteratively supplied to the ice tray to make ice, comprises steps of measuring the temperature of the ice tray after the water supply operation of the water supply means to the ice tray is executed and determining that the water has not been supplied to the ice tray where the measured temperature is below a predetermined reference value.

When the water supply operation is executed by the water supply means an water is actually supplied to the ice tray, the temperature of the ice tray filled with ice theretofore is increased. Such temperature increase does not take place in the ice tray when th water has not been actually supplied to the ice tray. Since it is determined that the water has not been supplied to the ice tray when the temperature of the ice tray is below a predetermined reference value after execution of the water supply operation to the ice tray, the water unsupplied condition of the ice tray may be accurately detected. It is preferable that alarming operation take place when it is determined that the water has not been supplied to the ice tray.

According to the invention, the ice maker of the refrigerator having refrigerating means comprises an ice tray provided in the refrigerator for containing water, which is refrigerated so that ice is obtained, ice removing means for removing the ice from the ice tray, water supply means for reiteratively supplying water to the ice tray every time the ice removing operation of the ice removing means is completed, a temperature sensor for sensing the temperature of the ice tray, and determination means for comparing the temperature of the ice tray sensed by the temperature sensor with a predetermined value and determining that the water has not been supplied to the ice tray where the sensed temperature is below the predetermined value.

According to the above-described ice maker, the temperature of the ice tray is increased when water is actually supplied to the ice tray by operation of the water supply means. When the water has not been actually supplied to the ice tray even though the water supply operation is executed by the water supply means, the temperature increase of the ice tray does not take place. Consequently, the water unsupplied condition of the ice tray may be accurately detected.

It is preferable that the refrigerator be provided with alarming means for alarming a user when it is determined that the water has not been supplied to the ice tray. Such alarming means may comprise a light emitting element, buzzer or the like.

Alarming operation of the alaming means may be interrupted when the reservoir tank is detached from the refrigerator and attached thereto again with water contained therein. For such construction, a reservoir tank detection switch may be provided for being activated when the reservoir tank is attached to the refrigerator and an alarming interrupting means may be provided for interrupting the alarming operation of the alarming means in the condition that the reservoir tank detection switch is being activated. Consequently, the user may be prevented from forgetting to attach the reservoir tank to the refrigerator.

Other and further objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

An embodiment of the present invention will now be described with reference to the accompanying drawings.

Figure 5:
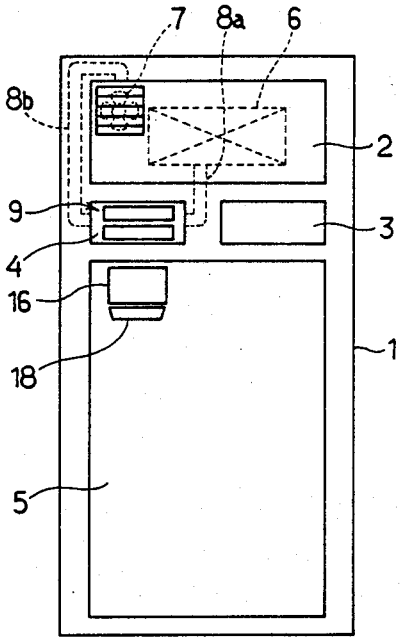
FIG. 5 is a front view of the refrigerator with the door eliminated.

Referring first to FIG. 5, a refrigerator cabinet 1 has at the interior a freezing compartment 2, a compartment 3 through which air is circulated for changing the temperature specification of the refrigerator, an ice making compartment 4 and a storage compartment 5. An evaporator 6 as refrigerating means is provided in a refrigerating compartment at the back of the freezing compartment 2. Air is sucked by fan means 7 from the compartments 2-5 to the refrigerating compartment and chilled by the evaporator 6. Chilled air is ciculated through the compartments 2-5. Of air circulation paths, only air circulation paths 8*a* and 8*b* for the ice making compartment 4 are shown in FIG. 5.

Figure 4:
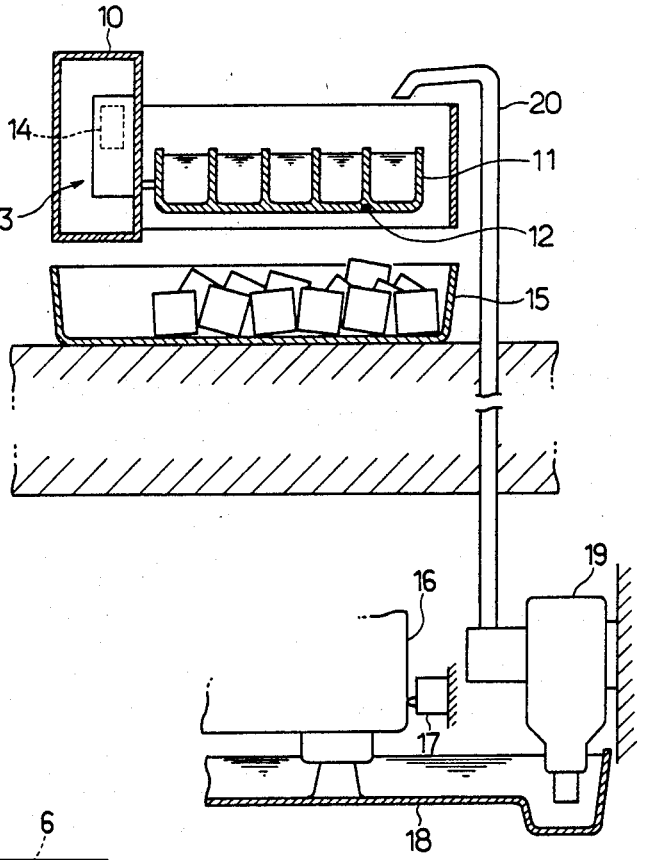
FIG. 4 is an enlarged longitudinal section of the ice maker in accrdance with the invention.

An ice maker 9 is provided in the ice making compartment 4 and the construction thereof will now be described. As shown in FIG. 4, a rectangular frame 10 is disposed in the ice making compartment 4. An ice tray 11 rotatably supported on a shaft so as to be reversed thereabout, the shaft being rotatably coupled to ice removing means 13. A temperature sensor 12 comprising a thermistor is provided in the bottom wall of the ice tray 11 for sensing the temperature of the ice tray 11. The temperature sensor 12 is adapted to produce a temperature detection signal the magnitude of which is in accordance with the sensed temperature. The ice removing means 13 is also mounted on the frame 10 for removing ice from the ice tray 11. The ice removing means 13 is driven by an electric motor 14. Rotational force induced by the motor 14 is transmitted to the ice removing means through a reduction gear mechanism (not shown), thereby reversing and slightly twisting the ice tray 11 such that the lumps of ice falls down, as well known in the art. An ice dispenser 15 is provided in the ice making compartment 4 so that the lumps of ice are received and reserved therein. The ice dispenser 15 may be taken out of the ice making compartment 4. A reservoir tank 16 is provided for reserving water made into ice in the ice tray 11. The reservoir tank 16 is disposed in a compartment other than the ice making compartment 4 in which the ice tray 11 is disposed, for example, in the storage compartment 5. The reservoir tank 16 may be taken out of the storage compartment 5 so that a user pours water into the tank 5. When the reservoir tank 16 is properly disposed in the storage compartment 5, a reservoir tank detection switch 17 is depressed by the reservoir tank 16 so as to be turned off. The reservoir tank detection switch 17 is adapted to produce a signal when it is turned on and then off. A pan 18 is disposed directly under the reservoir tank 16 and the water reserved in the reservoir tank 16 is supplied to the pan 18 so that a predetermined water level is usually maintained in the pan 18. The water supplied to the pan 18 is further supplied to the ice tray 11 through a hose 20 by a water supply pump 19 as water supply means.

Operation of the above-described ice maker 9 is controlled by control means 21 comprising a microcomputer. A temperature detection signal produced by the temperature sensor 12 and signal produced by the reservoir tank detection switch 17 are supplied to the control means 21. Based on the signals, the control means 21 controls, through a drive circuit 22, the motor 14 of the ice removing means 13, the water supply pump 19 and the light emitting diode 23 for energization and deenergization thereof in accordance with an operation program previously stored therein. More specifically, when the temperature of the ice tray 11 sensed by the temperature sensor 12 is below a reference value of −12° C. predetermined as a ice making completion temperature, for example, the control means 21 operates to energize the motor 14 for removal of ice from the ice tray 11. Further, when, after the water supply operation of the pump 19 to the ice tray 11, the temperature of the ice tray 11 is below a reference value of −9.5° C. predetermined for determination of the empty condition of the ice tray 11, for example, the control means 21 is adapted to determine that the water has not been supplied to the ice tray 11. Accordingly, the control means 21 operates as determination means for determining that the water has not been supplied to the ice tray 11 even though the water supply operation has been executed. When it is determined by the control means 21 that the water has not been supplied to the ice tray 11, the control means 21 operates to turn on a light emitting diode 23 as the alarming means. When the reservoir tank 16 is taken out of the storage compartment 5 and thereafter reset in the storage compartment 5 with water supplied thereto, the control means 21 operates to turn off the light emitting diode 23 on condition that the reservoir tank detection switch 17 is turned off with the reset of the reservoir tank 16. Accordingly, the control means 21 also serves as a deactivating means for deactivating the alarming means. Additionally, the light emitting diode 23 is mounted on the front side of an ice making compartment door (not shown) so that the user can perceives, form outside, the light emitted therefrom.

Figure 1:
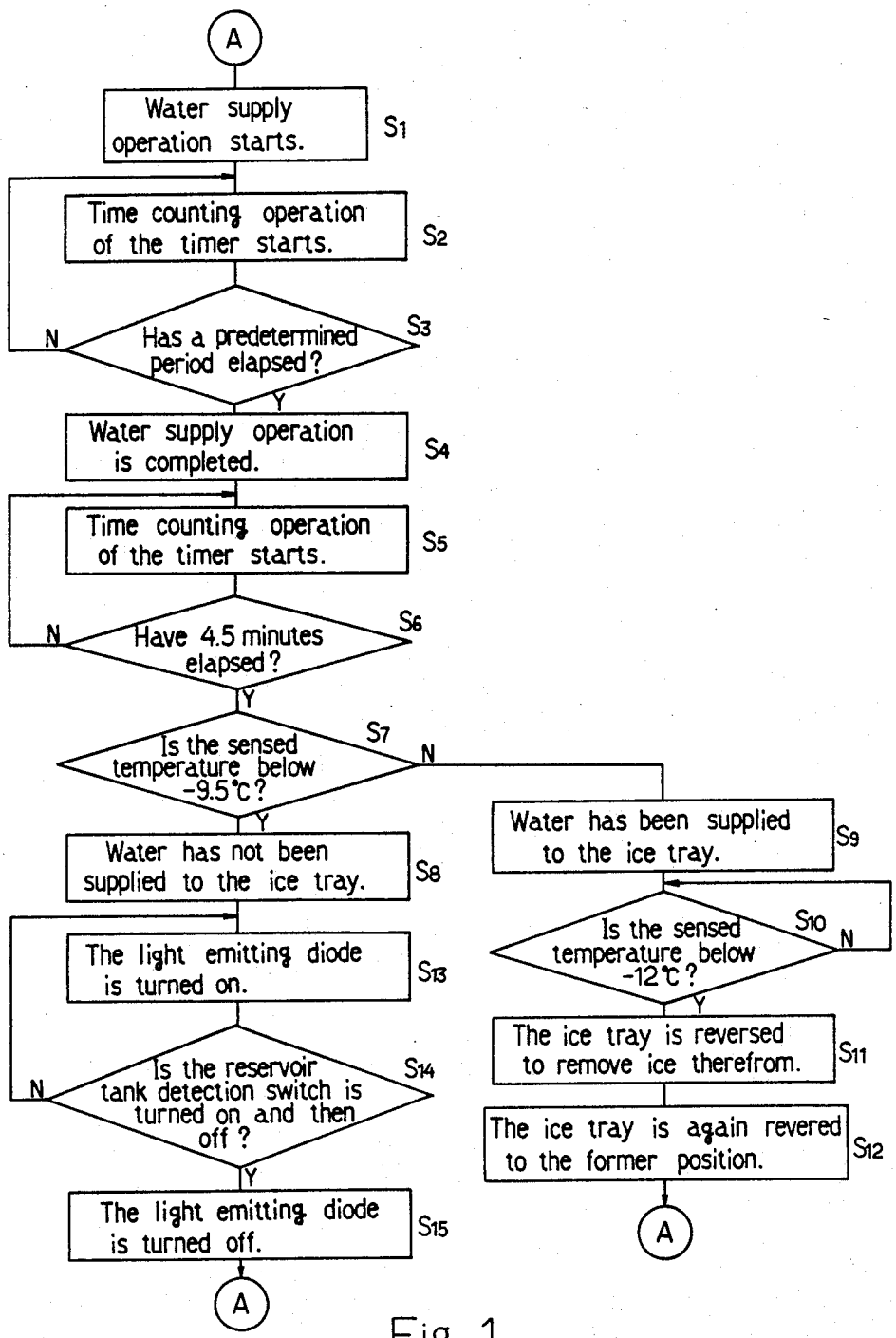
FIG. 1 is a flowchart showing operation steps to determine whether or not water has been supplied to the ice tray of the ice maker of a refrigerator in accordance with the present invention.
Figure 2:
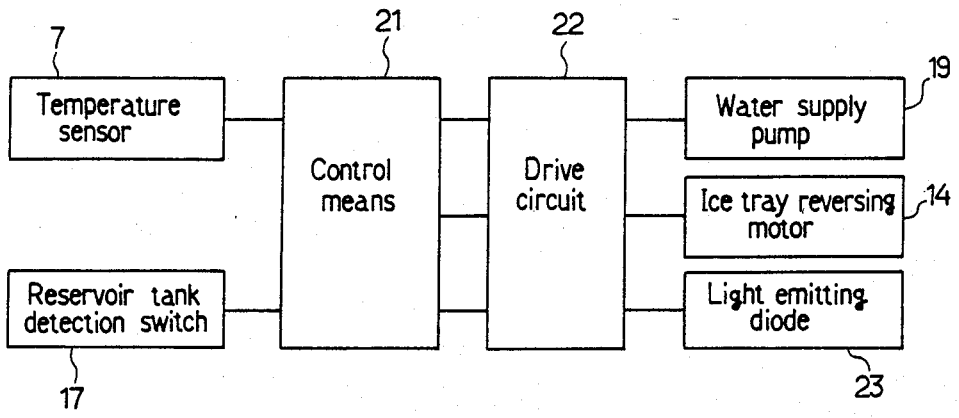
FIG. 2 is a block diagram showing control circuitry for controlling the ice maker.

Referring now to FIG. 1, the determination operation of the control means 21 will be described for the understanding of control contents thereof. Upon the starting of the water supply pump 19, water supplie to the pan 18 from the reservoir tank 16 is further supplied to the ice tray 11. Upon starting of the after supply operation to the ice tray 11, a timer (not shown) provided in the control means 21 starts the time counting operation, thereby timing the duration period of the water supply operation. When the water is continuously supplied to the ice tray 11 for a predetermined period so that the tray is filled with water, the water supply operation is completed (steps S1–S4). The timer again starts the time counting operation upon stop of the water supply operation. When 4.5 minutes elapses from the stop of the water supply operation (steps S5, S6), it is determined whether or not the temperature of the ice tray sensed by the temperature sensor 12 is below −9.5° C. previously determined for determination of the water unsupplied condition of the ice tray 12 (step S7). Where the temperature of the ice tray 11 is below −9.5° C., it is determined that the water has not been reserved in the ice tray 11 (step S8). When the temperature of the ice tray 11 exceeds the value of −9.5° C., it is determined that the water has been reserved in the ice tray 11 (step S9).

Figure 3:
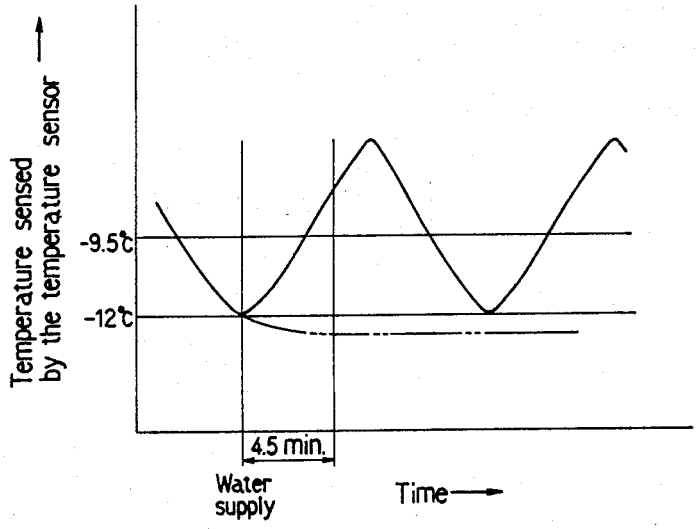
FIG. 3 is a graphical representation of changes of the temperature of the ice tray sensed by the temperature sensor under the condition that the water supply and ice making operations are alternately reiterated.

When the water is actually reserved in the ice tray 11 by the water supply operation, the temperature of the ice tray sensed by the temperature sensor 12 is gradually increased from the value of −12° C. as the ice making completion temperature. After elapse of 4.5 minutes from the water supply to the ice tray 11, the temperature of the ice tray 11 sensed by the temperature sensor 12 is increased to the value of −9.5° or more. The reason for the temperature increase is that since the reservoir tank 16 is disposed in the storage compartment 5 in which the temperature is usually maintained at the value of 2° or 3° C., the temperature of the ice tray 11 is increased owing to the water supplied thereto from the reservoir tank 16. When the reservoir tank 16 is empty and the water is actually not supplied to the ice tray 11, the temperature of the ice tray sensed by the temperature sensor is maintained at approximately −12° C. and not increased to the value of −9.5° C. since the ice tray 11 is not supplied with water, as shown by the alternate long and two short dashes line in FIG. 3. When the temperature of the ice tray 11 sensed by the temperature sensor 12 is below −9.5° C. 4.5 minutes after the completion of the water supply operation, it is determined that water has not been reserved in the ice tray 11.

Where it is determined that water is reserved in the ice tray 11 at step S9, it is then determined whether or not the temperature of the ice tray 11 sensed by the temperature sensor 12 has reached the ice making completion temperature of −12° C. (step S10). When the temperature of the ice tray 11 sensed by the temperature sensor 12 is decreased to the value of −12° C., it is determined that the ice making operation has been completed, whereby the motor 14 of the ice removing means 13 is energized. Consequently, the ice tray 11 is reversed and slightly twisted, thereby causing the ice to fall down int the ice dispenser 15 (step S11). The motor 14 is reverse rotated so that the ice tray 11 is reversed to the former position, after the removal of ice from the ice tray 11 (step S12). Subsequently, the ice making operation restarts with the initial operation step S1 and water is supplied to the ice tray 11. The ice making operation is thus reiterated and more and more lumps of ice are reserved in the ice dispenser 15.

Where it is determined at step S7 that the water has not been supplied to the ice tray 11, the light emitting diode 23 is turned on (step S13). When perceiving the light emitted from the light emitting diode 23, the user finds out that the reservoir tank 16 has been emptied and takes out the reservoir tank 16 to fill it with water with the reservoir tank detection switch 17 turned on. Then, the reservoir tank 16 is reset in the storage compartment 5 with the reservoir tank detection switch 17 turned off. At step S14, it is determined by the control means 21 whether or not the reservoir tank detection switch 17 is turned on and then off. When it is determined that the reservoir tank detection switch 17 is turned on and then off, the light emitting diode 23 is turned off (step S15) and the ice making operation is returned to the initial step S1.

According to the above-described embodiment, the temperature of the ice tray 11 is increased to the predetermined value or more when water is actually supplied to the ice tray 11. Accordingly, the temperature of the ice tray 11 is measured after the water supply operation. The measured temperature is compared with the predetermined reference value and it is determined that water has not been supplied to the ice tray 11 when the measured temperature is above the predetermined refrrence value. Consequently, it can be determined with high accuracy that water has not been supplied to the ice tray 11.

Further, since the temperature of the ice tray 11 is sensed after the water supply operation by the temperature sensor 12 which is provided for detecting the completion of the ice making operation, the increase of parts may be prevented.

Since the light emitting diode 23 is turned on when it is determined that water has not been supplied to the ice tray 11, the user easily finds out that ice cannot be made. The empty condition of the ice tray 1 signifies that the reservoir tank 16 has been emptied. Accordingly, the light emitting diode 23 also serves for informing the user that the reservoir tank 16 has been emptied. A desirable amount of ice cannot be obtained when the reservoir tank 16 is left empty but occurrence of such inconvenience may be prevented.

Further, when the reservoir tank 16 is taken out of the storage compartment 5, the light emitting diode 23 is kept turned on until the reservoir tank 16 is reset in the storage compartment 5. Accordingly, even when the reservoir tank 16 cannot be reset in the storage compartment 5 immediately after it is taken out of the compartment 5, the light emitting diode 23 is kept turned on, whereby the user may be prevented from forgetting to reset the reservoir tank 16.

Although the light emitting diode 23 is employed as the alarming means in the embodiment, a buzzer or other means may be employed. Furthermore, even when the user finds out that small amount of water is left in the reservoir tank 16, in the case where water is actually supplied to the ice tray 11, the reservoir tank 16 is taken out of the storage compartment 5 and consequently, the reservoir tank detection switch 17 is also turned on. The light emitting diode 23 is arranged to be turned on in this case so that the user is prevented from forgetting to reset the reservoir tank 16.

The foregoing disclosre and drawings are merely illustrative of the principles of the present invention and are not to be interpreted in a limiting sense. The only limitation is to be determined from the scope of the appended claims.

What we claim is:

1. A method of detecting water unsupplied condition of an ice tray of a refrigerator ice maker, wherein water supplied to the ice tray by water supply means is refrigerated by refrigerating means to thereby make ice, which is removed from the ice tray by ice removing means and wherein water is subsequently supplied to the ice tray to make ice, said method comprising steps of:

(a) measuring the temperature of the ice tray after the water supply operation of the water supply means to the ice tray is executed;

(b) comparing the measured temperature of the ice tray with a predetermined reference value; and (c) determining that the water has not been supplied to the ice tray, where the measured temperature of the ice tray is below the predetermined reference value.

2. A method according to claim 1, which further comprises a step of alarming when it is determined that the water has not been supplied to the ice tray.

3. An ice maker of a refrigerator including refrigerating means, comprising:

(a) an ice tray provided in the refrigerator for containing water, the water being refrigerated by the refrigerating means to make ice;

(b) ice removing means for removing the ice from the ice tray;

(c) water supply means for reiteratively supplying water to the ice tray every time the ice removing operation of the ice removing means is completed;

(d) a temperature sensor for sensing the temperature of the ice tray; and (e) determination means for comparing the temperature of the ice tray sensed by the temperature sensor with a predetermined reference value every time the water supplying operation of the water supply means is executed and determining that the water has not been supplied to the ice tray, where the temperature sensed by the temperature sensor is below the predetermined reference value.

4. An ice maker of a refrigerator according to claim 3, which further comprises alarming means for alarming when it is determined by the determination means that the water has not been supplied to the ice tray.

5. An ice maker of a refrigerator according to claim 4, wherein the alarming means comprises a buzzer.

6. An ice maker of a refrigerator according to claim 4, wherein the alarming means comprises a light emitting element.

7. An ice maker o f a refrigerator including refrigerating means and at least two partitioned interior compartments for which temperatures different from each other are set comprising:

(a) an ice tray provided in a low temperature compartment of the refrigerator for containing water, the water being refrigerated by the refrigerating means so that ice is made;

(b) ice removing means for removing the ice from the ice tray;

(c) a reservoir tank detachably mounted in a high temperature compartment of the refrigerator for reserving water supplied to the ice tray;

(d) a reservoir tank detection switch activated when the reservoir tank is mounted in the compartment;

(e) water supply means for supplying water reserved in the reservoir tank to the ice tray every time the ice removing operation of the ice removing means is completed;

(f) a temperature sensor for sensing the temperature of the ice tray;

(g) determination means for comparing the temperature of the ice tray sensed by the temperature sensor with a predetermined reference value every time the water supplying operation of the water supply means is executed and determining that the water has not been supplied to the ice tray, where the temperature of the ice tray sensed by the temperature sensor is below the predetermined reference value;

(h) alarming means for alarming when it is determined by the determination means that the water has not been supplied to the ice tray; and (i) deactivating mean for deactivating the alarming means when the reservoir tank detection switch is operated during the alarming operation of the alarming means.

* * * * *